US008499412B2

(12) United States Patent
Yokote et al.

(10) Patent No.: US 8,499,412 B2
(45) Date of Patent: Aug. 6, 2013

(54) ELECTRIC BLOWER AND ELECTRIC CLEANER WITH SAME

(75) Inventors: Shizuka Yokote, Osaka (JP); Michihiro Kurokawa, Osaka (JP); Akira Yamaguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/814,846

(22) PCT Filed: Dec. 26, 2011

(86) PCT No.: PCT/JP2011/007250

§ 371 (c)(1),
(2), (4) Date: Feb. 7, 2013

(87) PCT Pub. No.: WO2012/093460

PCT Pub. Date: Jul. 12, 2012

(65) Prior Publication Data

US 2013/0133156 A1 May 30, 2013

(30) Foreign Application Priority Data

Jan. 5, 2011 (JP) ..... 2011-000321

(51) Int. Cl.
*A47L 11/00* (2006.01)

(52) U.S. Cl.
USPC .... 15/412; 415/208.1; 415/209.1; 415/211.2; 417/423.2; 417/423.14

(58) Field of Classification Search
USPC . 15/412; 415/208.1, 209.1, 211.2; 417/423.2, 417/423.14
IPC ..... A47L 11/00
See application file for complete search history.

(56) References Cited

U.S. PATENT DOCUMENTS

2006/0280596 A1 12/2006 Kim et al.

FOREIGN PATENT DOCUMENTS

| | | | |
|---|---|---|---|
| JP | 59-074395 | A | 4/1984 |
| JP | 06-117398 | A | 4/1994 |
| JP | 2006-342792 | A | 12/2006 |
| JP | 2008-025440 | A | 2/2008 |
| JP | 2009-299636 | A | 12/2009 |

OTHER PUBLICATIONS

International Search Report for International Application No. PCT/JP2011/007250, dated Mar. 19, 2012, 2 pages.

*Primary Examiner* — David Redding
(74) *Attorney, Agent, or Firm* — Brinks Hofer Gilson & Lione

(57) ABSTRACT

An electric blower includes a stator, a rotor, a bracket, rotary fan, air guide, a fan case covering air guide and rotary fan. Air guide includes a partition plate, a diffuser, a partition slope, and a guide vane. Diffuser vanes configure closed passages. Passage lengths of closed passages include a first passage length and a second passage length that is different from the first passage length.

9 Claims, 6 Drawing Sheets

ELECTRIC BLOWER AND ELECTRIC CLEANER WITH SAME

This application is a 371 application of PCT/JP2011/007250 having an international filing date of Dec. 26, 2011, which claims priority to JP2011-000321 filed Jan. 5, 2011, the entire contents of which are incorporated herein by reference.

TECHNICAL FIELD

The present invention relates to electric blowers used in electric appliances, and electric vacuum cleaners equipped with this electric blower.

BACKGROUND ART

First, a structure of a conventional electric blower is described below.

The conventional electric blower includes a stator, a rotor, a bracket, a rotary fan, an air guide, and a fan case.

The conventional electric blower converts dynamic pressure obtained by the centrifugal force of the rotary fan to static pressure by the air guide to generate air output.

The conventional electric blower is configured such that a large distance is secured between a rear rim (trailing edge) of the rotary fan and a front rim of a diffuser, so as to reduce noise.

Other structures have been proposed, including a structure to suppress pressure fluctuation when a rear rim of a rotary fan impeller crosses the front rim of the diffuser and a structure to reduce the number of revolutions of the rotary fan.

In addition, to reduce resonance inside a flow passage, a structure is proposed to suppress resonance and reduce impeller sound by providing a through hole at a position where a wave node exists. (e.g., PTL 1)

In the conventional air blower as configured above, airflow slip at the rear rim of impeller or backflow increases if a distance between the rear rim of the rotary fan and the front rim of the diffuser becomes long. This increases pressure loss.

Dynamic pressure generated by the rotary fan reduces if the number of revolutions reduces in the conventional electric blower. As a result, the air-blow efficiency reduces.

Furthermore, a through hole is provided at a position where a wave node of resonance exists in PTL 1. This reduces resonance in a flow passage. If the flow passage is short in this type of the conventional electric blower, the resonance node, which is a passage outlet, is positioned in a semi-open area. This significantly reduces the air-blow efficiency. In addition, assembly becomes difficult if a through hole is provided at a position where the wave node of resonance exists. The air blower cannot be manufactured using upper and lower dies. A separate horizontal die becomes necessary. If the diffuser and a partition plate are configured separately, assembly becomes difficult.

PTL1 Japanese Patent Unexamined Publication No. 2009-299636

SUMMARY OF THE INVENTION

An electric blower of the present invention takes this disadvantage into account, and reduces noise.

The electric blower of the present invention includes a stator, a rotor rotatably supported inside the stator and rotating on a rotary shaft, a bracket supporting the stator, a rotary fan attached to the rotary shaft, an air guide disposed between the bracket and the rotary fan, and a fan case with an air inlet at its center and covering the air guide and the rotary fan. The air guide includes a partition plate disposed between the bracket and the rotary fan, a diffuser disposed on an outer periphery of the rotary fan and is configured with multiple diffuser vanes, a partition slope that makes contact with a bottom face of the diffuser and tilted, and a guide vane formed on a rear face of the diffuser via the partition plate. The diffuser vanes form closed passages, and passage lengths of the closed passages are set to a first passage length and a second passage length that is different from the first passage length.

An electric vacuum cleaner of the present invention is equipped with this electric blower.

DETAILED DESCRIPTION OF THE PREFERRED EMBODIMENTS (Exemplary Embodiment)

An exemplary embodiment of the present invention is described below with reference to drawings.

Figure 1A:
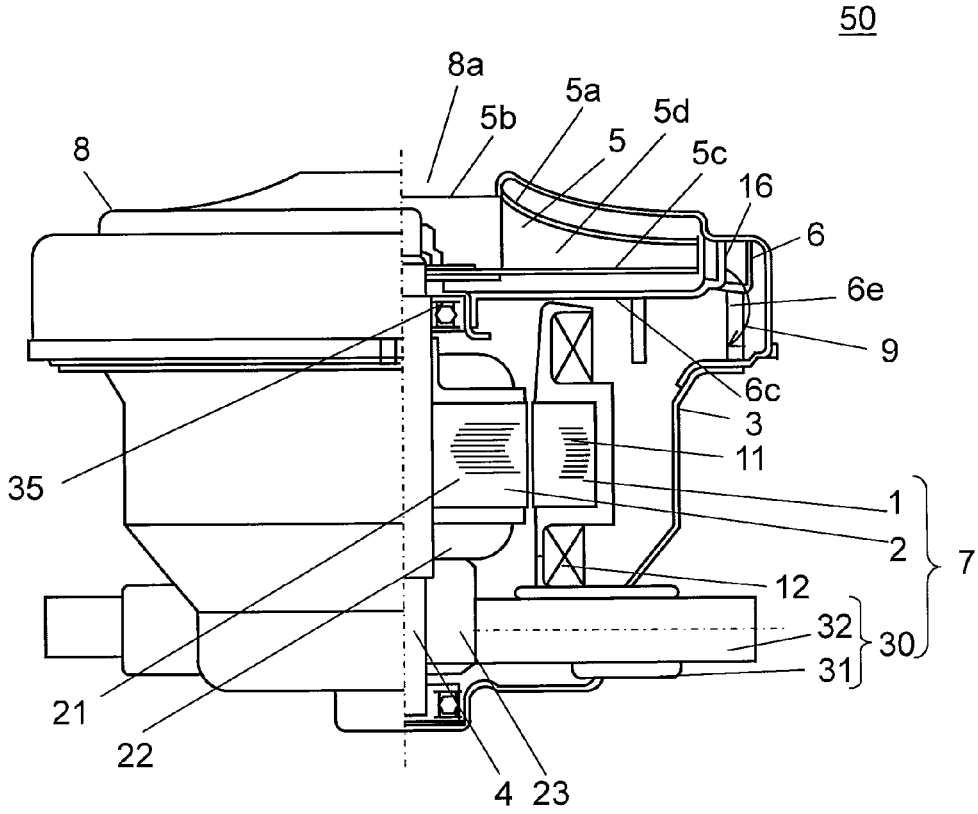
FIG. 1A is a sectional view of an electric blower in accordance with an exemplary embodiment of the present invention.

FIG. 1A is a sectional view of an electric blower in the exemplary embodiment of the present invention.

Electric blower 50 includes motor 7, bracket 3, rotary fan 5, air guide 6, and fan case 8. Motor 7 includes stator 1, rotor 2, and brush unit 30.

In motor 7, field winding 12 is wound around field core 11 to form stator 1.

Rotor 2 includes armature core 21, armature winding 22, commutator 23, and rotary shaft 4. Armature winding 22 is partly connected to commutator 23. Armature winding 22 is wound around armature core 21. This commutator 23 and armature core 21 are attached to rotary shaft 4. Rotor 2 configured in this way is provided inside stator 1, and is rotatably supported centering on rotary shaft 4.

Stator 1 is fixed inside bracket 3. Brush holder 31 is also fixed onto bracket 3. A pair of carbon brushes 32 is held inside brush holder 31. This pair of carbon brushes 32 makes contact with commutator 23.

Brush unit 30 includes these carbon brushes 32 and brush holder 31.

One end of rotary shaft 4 protrudes from the top of bracket 3. Both ends of rotary shaft 4 are rotatably supported by bearings 35, respectively.

Rotary fan 5 is attached to the end of rotary shaft 4 protruding from bracket 3. Air guide 6 is provided forming an air passage around the outer periphery of rotary fan 5.

Rotary fan 5 has side plate (shroud) 5*a* and main plate (disk) 5*c*. Impeller 5*d* is disposed and fixed between side plate 5*a* and main plate 5*c*. Rotary fan 5 has multiple impellers 5*d* on its main plate 5*c* such that impellers 5*d* are disposed at an equal interval in a spiral manner. In addition, rotary fan 5 has opening 5*b* on side plate 5*a* at its center for sucking in air.

Air guide 6 is provided on the outer periphery of rotary fan 5 to form an air passage. To cover an open side of bracket 3, fan case 8 is attached. Fan case 8 has air inlet 8*a* at its center and is disposed to cover air guide 6 and rotary fan 5.

Next is described the air guide in the exemplary embodiment of the present invention as configured above with reference to drawings.

Figure 1B:
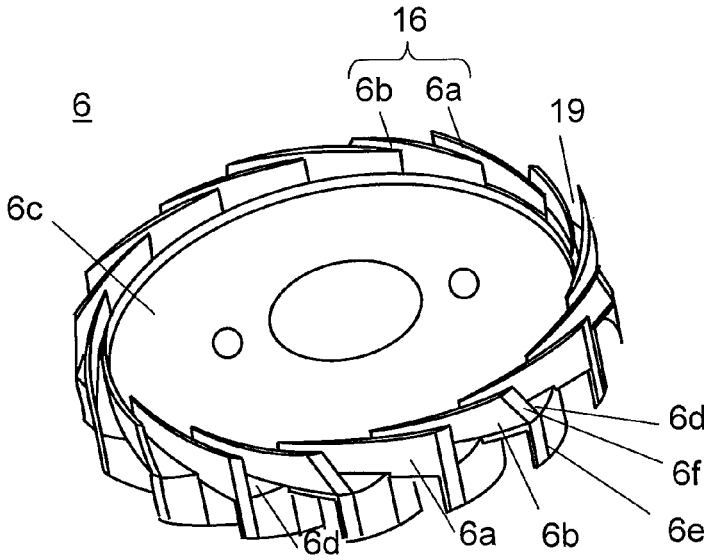
FIG. 1B is a perspective view of an air guide in accordance with the exemplary embodiment of the present invention.

FIG. 1B is a perspective view of air guide 6 in the exemplary embodiment of the present invention.

As shown in FIG. 1B, air guide 6 includes partition plate 6*c*, diffuser 16, partition slope 6*d* and guide vane 6*e*.

Partition plate 6*c* is provided to divide between bracket 3 and rotary fan 5.

Diffuser 16 is configured with multiple diffuser vanes disposed on the outer periphery of rotary fan 5. The diffuser vanes protrude from partition plate 6*c* to the side of fan case 8, and are curved from the side of inner periphery to outer periphery.

Still more, in the exemplary embodiment as shown in FIG. 1B, multiple diffuser vanes include first diffuser vane 6*a* and second diffuser vane 6*b*. Second diffuser vane 6*b* is shorter than first diffuser vane 6*a* in the vane-extending direction in the exemplary embodiment. More specifically, second diffuser vane 6*b* has an obliquely chipped portion 6*f* at its outlet side, as shown in FIG. 1B, to shorten second diffuser vane 6*b*. The exemplary embodiment gives an example of disposing first diffuser vane 6*a* and second diffuser vane 6*b* alternately.

Partition slope 6*d* makes contact with a bottom face of diffuser 16 to tilt it. In other words, partition slope 6*d* is tilted from an inlet of air guide 6 to an outlet in the outer periphery direction toward the side where motor 7 is disposed.

Guide vane 6*e* is formed on a rear face of diffuser 16 via partition plate 6*c*.

Closed passage 19 is formed by two adjacent diffuser vanes 6*a* and 6*b*, and partition slope 6*d*.

In electric blower 50 as configured above, armature current runs to armature winding 22 via carbon brush 32 and commutator 23 when external power is supplied to motor 7. Field current runs to field winding 12 of stator 1. Then, a force is generated between magnetic flux generated at field core 11 by the field current and the armature current running in the armature winding. This rotates rotary shaft 4.

In line with the rotation of rotary shaft 4, rotary fan 5, which is fixed to rotary shaft 4 typically by a nut, rotates.

By the rotation of rotary fan 5, a flow rate of air inside rotary fan 5 increases and a flow of sucked air occurs at opening 5*b* provided on side plate 5*a*.

This flow is bent by about 90° from the rotating axis direction to a radial direction, and travels outward in the radial direction while dynamic pressure is given by impellers 5*d*.

Air flowing out from rotary fan 5 is guided to air guide 6 disposed on the outer periphery of rotary fan 5. Then, the flow rate is reduced while passing through closed passage 19 of air guide 6. Accordingly, air guide 6 converts sucked air from dynamic pressure to static pressure.

The direction of airflow passing closed passage 19 is changed by 180° while passing through return passage 9 configured with air guide 6 and fan case 8. The airflow is then guided to inside motor 7 by guide vane 6*e*. The airflow is then discharged outside after cooling motor 7.

Figure 2:
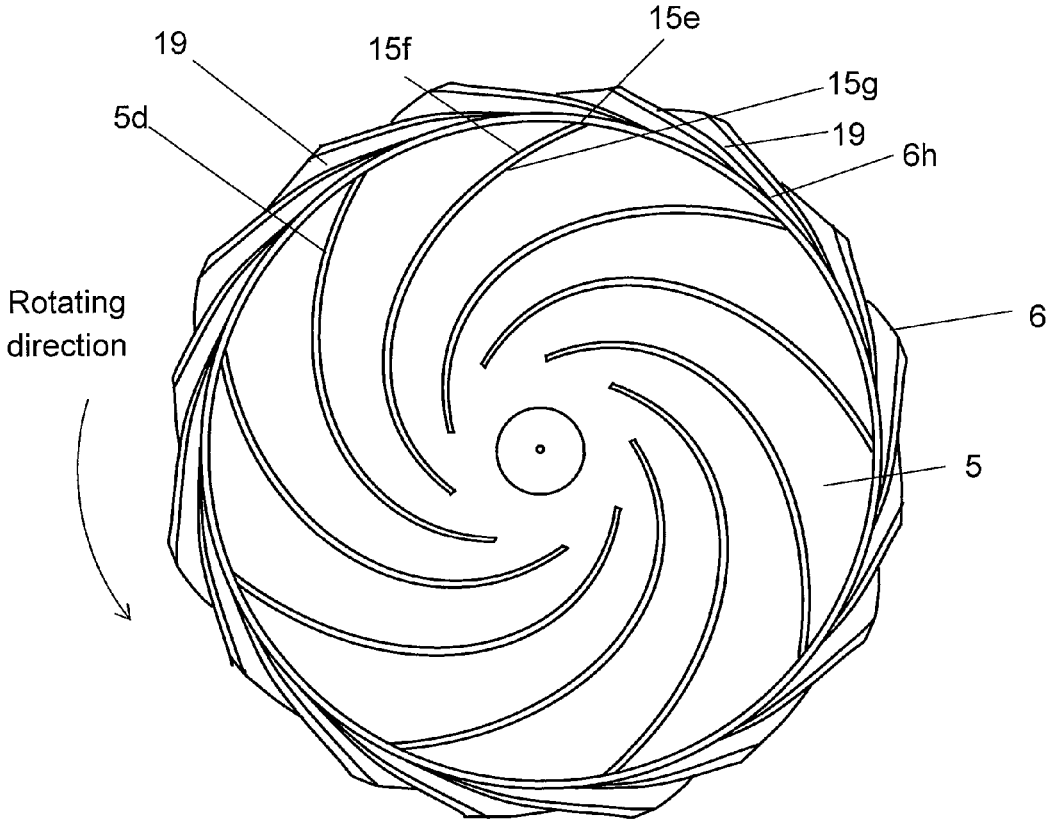
FIG. 2 illustrates arrangements of a rotary fan and an air guide.

FIG. 2 shows arrangements of rotary fan 5 and air guide 6.

Next, a cause of noise generated from air blower 50 is described with reference to FIG. 2.

Rotary fan 5 rotates in a direction indicated by an arrow in FIG. 2.

In line with the rotation of rotary fan 5, a high pressure is applied to pressure face 15*f* of impeller 5*d* that works greatly on fluid. Contrarily, negative-pressure face (suction face) 15*g* of impeller 5*d* work less on fluid, and thus a pressure lower than that on pressure face 15*f* is applied to negative-pressure face 15*g*. Accordingly, pressure inside closed passage 19 becomes high when pressure face 15*f* faces passage inlet 6*h* of diffuser 16. When negative-pressure face 15*g* faces passage inlet 6*h*, a pressure inside closed passage 19 becomes low. As a result, a rate of pressure change inside closed passage 19 in line with the rotation of rotary fan 5 becomes the greatest when trailing edge 15*e* of rotary fan 5 passes. Accordingly, pressure fluctuation multiplied by the number of impellers 5*d* per rotation of rotary fan 5 occurs in air guide 6 in a coordinate system at rest.

This pressure fluctuation at trailing edge 15*e* of the rotary fan is the largest cause of noise generated from electric blower 50.

The pressure fluctuation generated as described above propagates in the form of sonic wave. Next, the sonic wave propagating inside air guide 6 is described.

Figure 3:
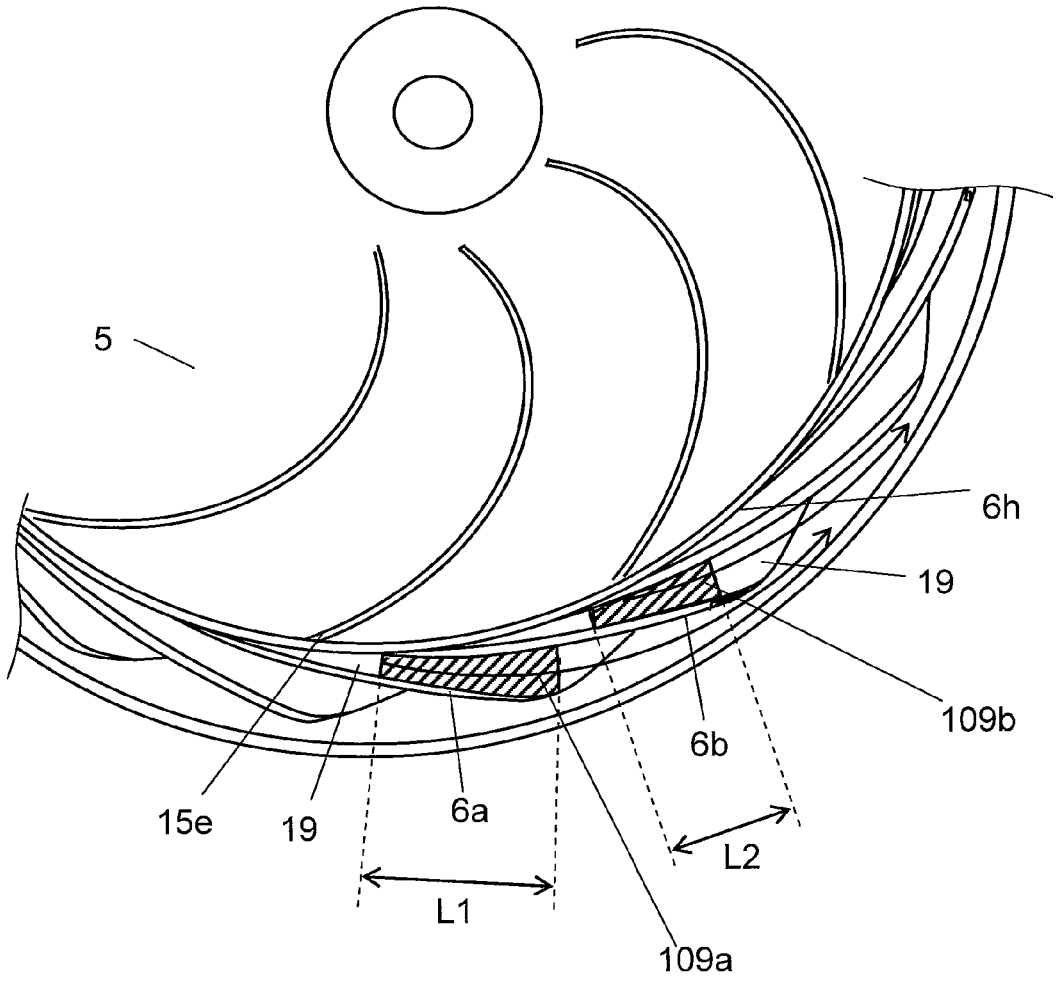
FIG. 3 is a front view of the air guide in accordance with the exemplary embodiment of the present invention.

FIG. 3 is a front view of air guide 6 in the exemplary embodiment of the present invention.

As described above, as shown in FIG. 1B, the exemplary embodiment includes two types of diffuser vanes that are first diffuser vane 6*a* and second diffuser vane 6*b* with different lengths from each other. Accordingly, closed passages 19 with different lengths are formed.

Closed passage 19 is a portion surrounded by first diffuser vane 6*a*, second diffuser vane 6*b*, and partition slope 6*d* (FIG. 1B).

The passage length of closed passage 19 is indicated by diagonal strokes in FIG. 3. Closed passage 19 is a space where first diffuser vane 6*a* and second diffuser vane 6*b* are overlaid with respect to the rotating direction of rotary fan 5, and is surrounded together with partition slope 6*d*.

The passage length is a length of the space surrounded by aforementioned two diffuser vanes and partition slope 6*d* (FIG. 1B), and indicates a length that first diffuser vane 6*a* and second diffuser vane 6*b* are mutually overlaid with respect to the rotating direction of rotary fan 5.

FIG. 3 shows first closed passage 109*a* in which first diffuser vane 6*a* that is a longer vane receives the airflow. FIG. 3 also shows second closed passage 109*b* in which second diffuser vane 6*b* that is a shorter vane receives the airflow. As shown in FIG. 3, passage length L1 of closed passage 109*a* is formed such that it becomes longer than passage length L2 of closed passage 109*b*.

In this structure, when rotary fan 5 rotates, a sonic wave is generated at trailing edge 15*e* of rotary fan 5 due to pressure fluctuation. Generated sonic wave propagates through closed passage 19 in a direction shown by an arrow in FIG. 3, and is synthesized with a sonic wave released from other closed passage 19 in return passage 9. For example, a sonic wave released from first closed passage 109*a* is synthesized with a sonic wave released from second closed passage 109*b* adjacent to first closed passage 109*a*, as shown in FIG. 3. A sonic wave at passage inlet 6*h* attenuates by passing through closed passage 19 of diffuser 16, or is affected, typically reflection or resonance, on a wall face of diffuser 16 or a wall face of fan case 8. Due to these influences, a sonic wave released from closed passage 19 will have a waveform different from that of a sonic wave at passage inlet 6*h* with respect to amplitude and frequency component.

Next, the passage length of closed passage 19 formed by diffuser 16, which is a cause of noise generation, is described by comparing structures of the present invention and a comparative example.

Figure 4A:
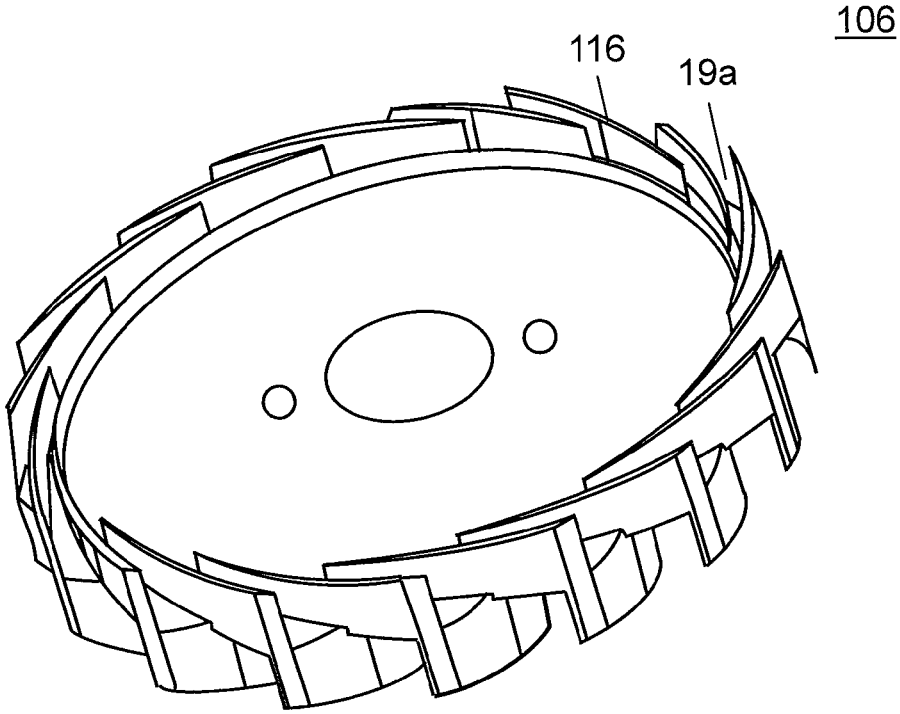
FIG. 4A is a perspective view of the air guide in a comparative example.
Figure 4B:
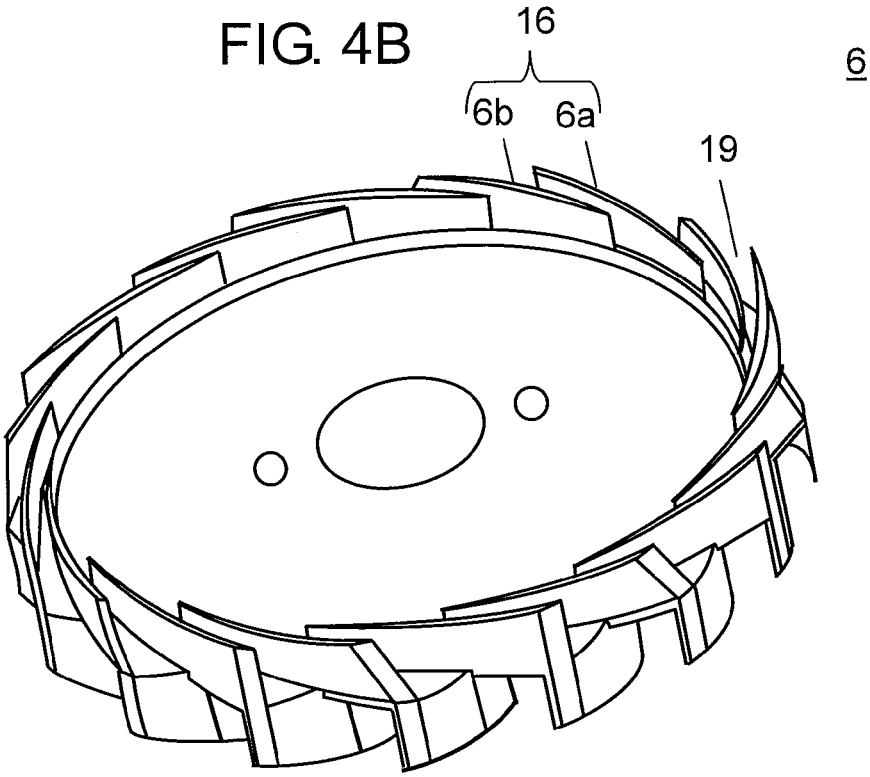
FIG. 4B is a perspective view of the air guide in accordance with the exemplary embodiment of the present invention.

FIG. 4A is a perspective view of air guide 106 in the comparative example. FIG. 4B is a perspective view of air guide 6 in the exemplary embodiment of the present invention.

First, air guide 106 in the comparative example is described.

Diffuser 116 in this air guide 106 is configured with diffuser vanes with the same shape, as shown in FIG. 4A.

Therefore, in case of the comparative example, the passage lengths of closed passages 19 formed by diffusers 116 are all substantially the same. This means waveforms of sonic waves released from closed passage outlets are also substantially the same. In other words, the sonic wave released from each closed passage outlet has a waveform mainly composed of a frequency of pressure fluctuation at the outlet of rotary fan 5. With consideration to a phase of the sonic wave, phases of the sonic waves released from adjacent passage outlets are almost the same. Sonic waves released from each of passage outlets are synthesized at the same phase. This increases amplitude, generating noise.

Next, air guide 6 in the exemplary embodiment of the present invention is described with reference to FIG. 4B. As described above, lengths of diffuser vanes 6*a* and 6*b* are different alternately. Accordingly, lengths of adjacent closed passages in closed passage 19 configured in diffuser 16 are also different.

If the passage length, which is a length of closed passage, differs, the size of an outlet area will also be different in addition to the passage length. Therefore, as shown in FIG. 3, conditions, such as attenuation, reflection, and resonance, at passing through the passage differ between closed passage 109*a* and closed passage 109*b* shown in FIG. 3. Accordingly, waveforms of sonic waves released from closed passage outlets are also different.

With respect to a phase of sonic wave released from the closed passage outlet, a phase difference in a circumferential direction of an angle calculated by (360°/number of diffuser vanes) occurs between adjacent closed passage outlets. Furthermore, in the exemplary embodiment, a phase difference also occurs in a flow direction between adjacent passages because lengths of adjacent passages differ. Therefore, amplitude of a synthesized wave of these waves becomes smaller than that of sonic waves at the same phase. More specifically, the phase difference in sonic waves cancels amplitudes of sonic waves. As a result, noise reduces.

Figure 5A:
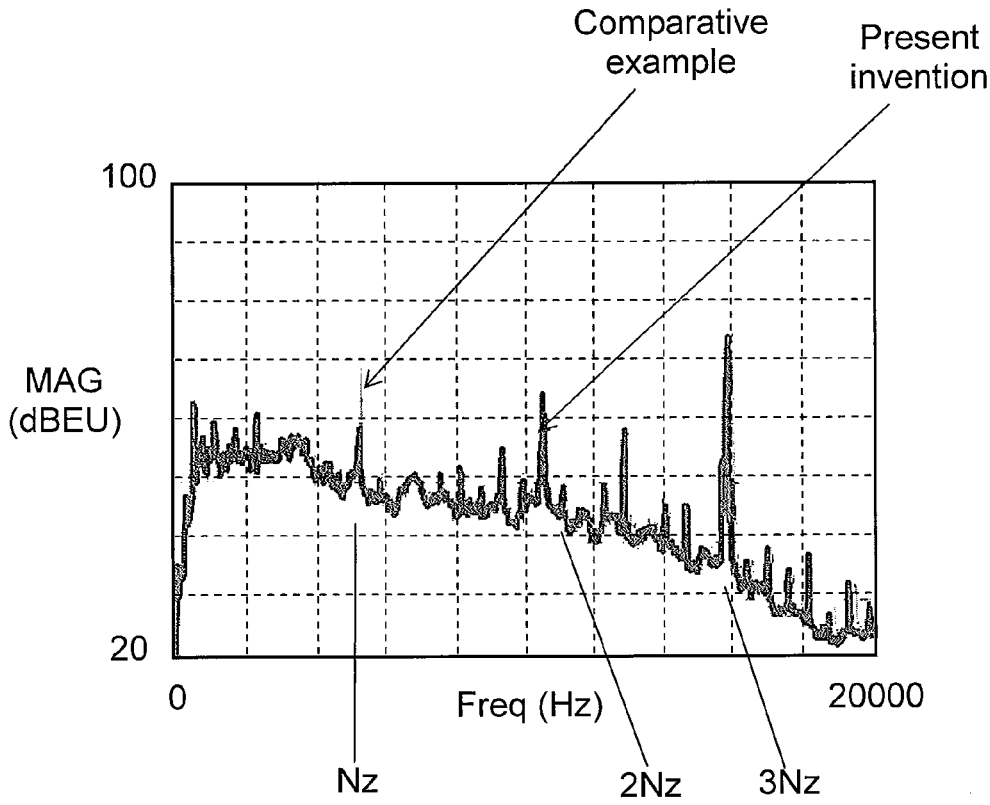
FIG. 5A shows frequency analysis results of noises in the present invention and the comparative example.
Figure 5B:
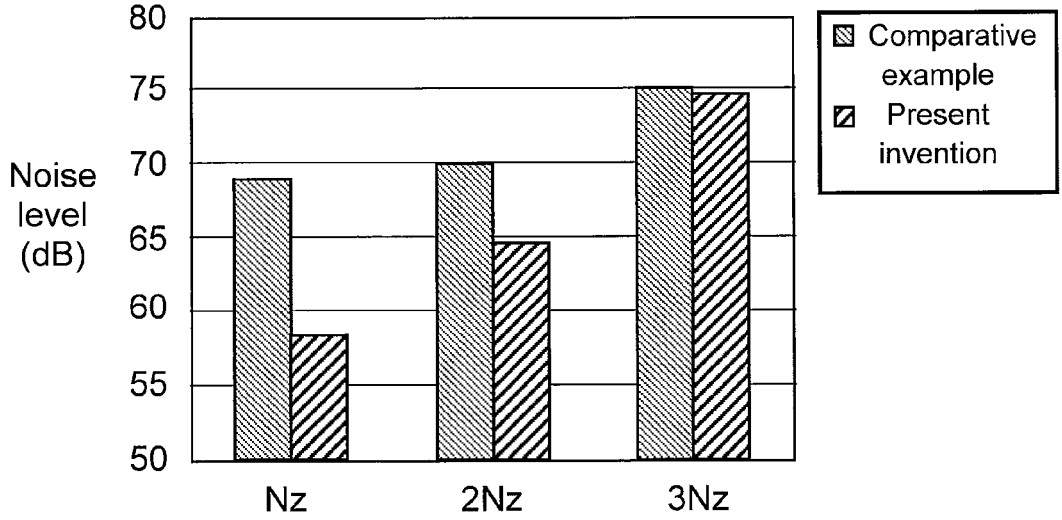
FIG. 5B shows comparative example of the intensity of Nz sound of basic wave, 2Nz sound of twofold high-harmonic, and 3Nz sound of threefold high-harmonic.

FIG. 5A is frequency analysis results of noise of the present invention and the comparative example. FIG. 5B compares intensity of Nz sound of basic wave, 2Nz sound of twofold high-harmonic, and 3Nz sound of threefold high-harmonic in FIG. 5A.

FIG. 5A shows an intensity distribution of noise frequency component by applying FFT analysis based on Fourier transform to noise of the electric blower of the present invention and the comparative example. As shown in FIGS. 5A and 5B, Nz sound, which is the basic wave of noise, has significantly reduced in the present invention, compared to an example of the prior art. The Nz sound is a dominant frequency component generated from the rotary fan, and is calculated by (number of revolutions)×(number of rotary fan impellers). A reduction effects are also noticed for frequencies of the 2Nz sound and 3Nz sound, which are multiples of Nz sound.

Furthermore, according to the experiment of comparing efficiency of the electric blowers, the maximum efficiency has increased by about 1 point when input to the electric blowers are set equivalent. This may be a result of the disturbed-flow moderating effect. By making the diffuser vanes partially short, disturbed flow and collision loss in airflow have also reduced. Based on this result, it is apparent that the efficiency will not always reduce even if chipped portion 6*f* is created in the diffuser vanes.

Based on the above reasons, the electric blower using the air guide configured with the diffuser forming different passage lengths can reduce noise without decreasing the output.

The passage length is set to satisfy the following formula:

$$|L1-L2|=(\lambda/2)(2\times m-1)(m \text{ is integer})$$

where v is a flow rate at the passage outlet of the diffuser, n is a number of revolutions of the rotary fan, z is a number of impellers of the rotary fan, and λ, is a wavelength of sound at the passage outlet, where λ=λ/(n×z) is established, L1 is the first passage length, and L2 is the second passage length. In other words, an absolute value of a difference in passage lengths L1 and L2 is set to an odd multiple of a half of wavelength λ. This encourages cancellation of amplitudes of sonic waves with this phase difference. Accordingly, the dominant Nz sound in the electric blower can be significantly reduced.

To reduce frequency of a k multiple of the Nz sound (k is integer), the passage lengths are set to satisfy the following formula:

$$|L1-L2|=(\lambda/2)(2\times m-1)/k(m \text{ and } k \text{ are integers})$$

where v is a flow rate at the passage outlet of the diffuser, n is a number of revolutions of the rotary fan, z is a number of impellers of the rotary fan, and is a wavelength of noise at the passage outlet, where λ=v/(n×z) is established, L1 is the first passage length, and L2 is the second passage length.

A phase difference in sonic waves becomes equivalent to an odd multiple of ½ wavelength of a frequency of a k multiple of Nz. Accordingly, sonic waves cancel each other, and thus the Nz sound that is dominant in the electric blower can be significantly reduced.

If m is increased, a difference in passage lengths becomes greater, which is not practical. Accordingly, m is preferably set to 1. For example, to respond to the Nz sound, an absolute value of a difference in wavelengths L1 and L2 is preferably set to a half of wavelength λ.

A passage with the first passage length and a passage with the second passage length, which is different from the first passage length, are disposed alternately in the rotating direction. Adjacent passages thus demonstrate the noise-reducing effect. In addition, the noise-reducing effect is demonstrated entirely in the circumferential direction. Accordingly, the noise or pressure extends throughout the passages without being focused in the circumferential direction. Noise can thus be reduced.

The above description refers to closed passages 19 with different passage lengths. This passage length is determined by a length of vane of diffuser 16. In other words, if vane lengths of two diffusers 16 are L1 and L2, a length of each diffuser vane 16 may be set based on the aforementioned formula.

To reduce noise, sonic waves released from adjacent closed passage outlets are set to different phases as described above. In other words, the noise-reducing effect is achieved even if the aforementioned formula is not accurately applied. Accordingly, for example, diffuser vanes 16 may be configured to have partially-different lengths. The exemplary embodiment gives an example of providing chipped portion 6*f* where second diffuser vane 6*b* is obliquely cut at the outlet, as shown in FIGS. 1B and 4B. This structure also generates a phase difference between synthesized sonic waves, and thus noise can be reduced. In the exemplary embodiment, chipped portion 6*f* has an oblique shape to suppress acute change in airflow while reducing noise. The shape of chipped portion 6*f* may be changed as appropriate. Alternately, a protrusion may be provided to make the diffuser vane longer so that there will be a difference in lengths of two diffuser vanes. Lengths between two diffuser vanes are made at least partially different by providing a chipped portion or protrusion at the outlet side of one diffuser vane extending in a curved shape. In a word, the effect is achieved as long as the passage length is changed. A phase difference in an odd multiple of a half of wavelength λ is preferably generated between synthesized sonic waves by this length difference.

The exemplary embodiment gives an example of reducing an outer diameter at the side of inlet of diffuser vane, e.g., a direction of a top face of air guide 6, as means for changing the passage length. However, the present invention is not limited to the exemplary embodiment as long as the passage length is changed.

The exemplary embodiment of the present invention also gives an example of the diffuser with two types of passage lengths. However, the present invention is not limited to the exemplary embodiment. In other words, the second passage length is given as an example of a passage length longer than the first passage length. However, the second passage length may be a closed passage shorter than that of the first passage length. This is because the point is to gain an effect of cancelling amplitudes of sonic waves by the phase difference in sonic waves.

Furthermore, electric blower 50 in the exemplary embodiment may be installed in an electric vacuum cleaner. An example of installing electric blower 50 in the exemplary embodiment in the electric vacuum cleaner is described.

Figure 6:
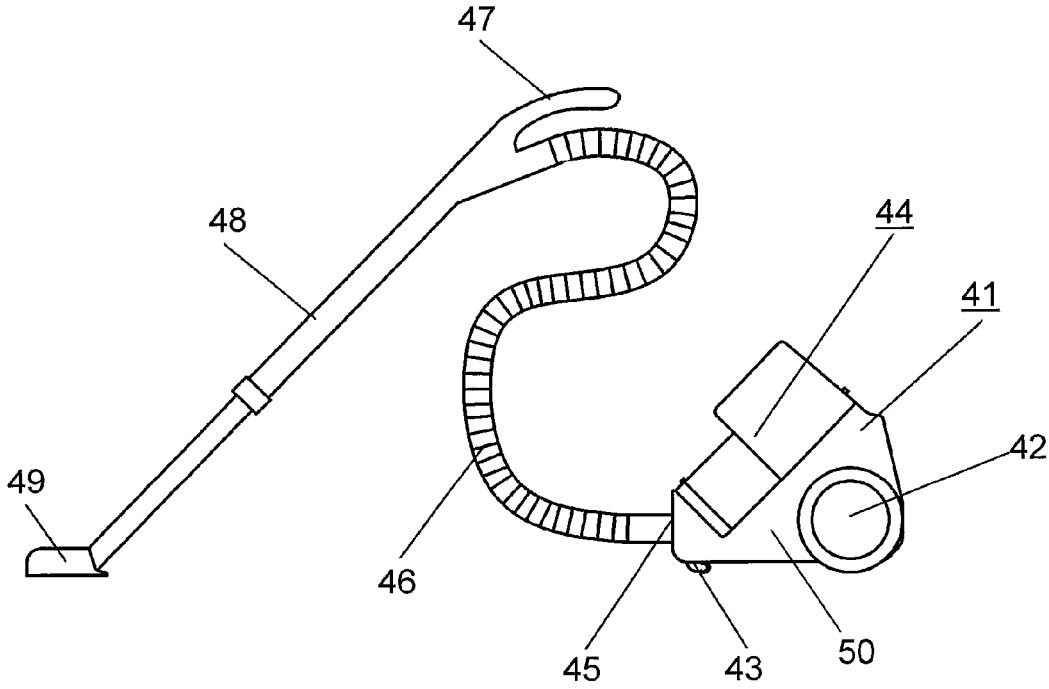
FIG. 6 is an external view of an electric vacuum cleaner in accordance with the exemplary embodiment of the present invention.

FIG. 6 is an external view of the electric vacuum cleaner in the exemplary embodiment of the present invention.

As shown in FIG. 6, wheel 42 and caster 43 are attached on an outer part of vacuum cleaner body 41. Vacuum cleaner 41 can thus freely move on the floor.

Suction inlet 45 provided at a bottom part of vacuum cleaner 41 is sequentially connected to hose 46 and extension pipe 48 where handle 47 is formed. Suction tool 49 is attached to a tip of extension pipe 48.

Electric vacuum cleaner body 41 is equipped with electric blower 50 in the exemplary embodiment. Dust-collecting case 44 is detachably provided on electric vacuum cleaner body 41. Dust-collecting case 44 takes in air including dust. This can reduce noise without making the size of the body larger or heavier. The electric vacuum cleaner can thus ensure strong suction power. Accordingly, cleaning performance of the vacuum cleaner can be improved.

INDUSTRIAL APPLICABILITY

The electric blower of the present invention is suited for reducing noise, and is effectively applicable to household vacuum cleaners.

The invention claimed is:

1. An electric blower comprising a stator, a rotor rotatably supported inside the stator and rotating on a rotary shaft, a bracket supporting the stator, a rotary fan attached to the rotary shaft, an air guide disposed between the bracket and the rotary fan, and a fan case with an air inlet at its center and covering the air guide and the rotary fan; the air guide comprising:

a partition plate disposed between the bracket and the rotary fan;

a diffuser disposed on an outer periphery of the rotary fan and including a plurality of diffuser vanes;

a partition slope making contact with a bottom face of the diffuser and tilted; and a guide vane formed on a rear face of the diffuser via the partition plate;

wherein the diffuser vanes form closed passages, and passage lengths of the closed passages are set to a first passage length and a second passage length that is different from the first passage length, and further wherein $|L1-L2|=(\lambda/2)\ (2\times m-1)$ (m is integer) is established, where v is a flow rate at a passage outlet, n is a number of revolutions of the rotary fan, z is a number of impellers of the rotary fan, λ is a wavelength of sound at the passage outlet, where $\lambda=v/(n\times z)$ is established, L1 is the first passage length, and L2 is the second passage length.

2. An electric blower comprising a stator, a rotor rotatably supported inside the stator and rotating on a rotary shaft, a bracket supporting the stator, a rotary fan attached to the rotary shaft, an air guide disposed between the bracket and the rotary fan, and a fan case with an air inlet at its center and covering the air guide and the rotary fan; the air guide comprising:

a partition plate disposed between the bracket and the rotary fan;

a diffuser disposed on an outer periphery of the rotary fan and including a plurality of diffuser vanes;

a partition slope making contact with a bottom face of the diffuser and tilted; and a guide vane formed on a rear face of the diffuser via the partition plate;

wherein the diffuser vanes form closed passages, and passage lengths of the closed passages are set to a first passage length and a second passage length that is different from the first passage length, and further wherein $|L1-L2|=(\lambda/2)\ (2\times m-1)/k$ (m and k are integers) is established, where v is a flow rate at a passage outlet, n is a number of revolutions of the rotary fan, z is a number of impellers on the rotary fan, λ is a wavelength of sound at the passage outlet, where $\lambda=v/(n\times z)$ is established, L1 is the first passage length, and L2 is the second passage length.

3. An electric blower comprising a stator, a rotor rotatably supported inside the stator and rotating on a rotary shaft, a bracket supporting the stator, a rotary fan attached to the rotary shaft, an air guide disposed between the bracket and the rotary fan, and a fan case with an air inlet at its center and covering the air guide and the rotary fan; the air guide comprising:

a partition plate disposed between the bracket and the rotary fan;

a diffuser disposed on an outer periphery of the rotary fan and including a plurality of diffuser vanes;

a partition slope making contact with a bottom face of the diffuser and tilted; and a guide vane formed on a rear face of the diffuser via the partition plate;

wherein the diffuser vanes form closed passages, and the diffuser includes a first diffuser vane and a second diffuser vane that has a length different from that of the first diffuser vane, further wherein the second diffuser vane has a chipped portion at a side of outlet, and passage lengths of the closed passages are set to a first passage length and a second passage length that is different from the first passage length.

4. An electric vacuum cleaner equipped with the electric blower of claim 1.

5. An electric vacuum cleaner equipped with the electric blower of claim 2.

6. An electric vacuum cleaner equipped with the electric blower of claim 3.

7. The electric blower of claim 1, wherein the closed passages include a passage with the first passage length and a passage with the second passage length disposed adjacent to each other with respect to a rotating direction of the rotary fan.

8. The electric blower of claim 2, wherein the closed passages include a passage with the first passage length and a passage with the second passage length disposed adjacent to each other with respect to a rotating direction of the rotary fan.

9. The electric blower of claim 3, wherein the closed passages include a passage with the first passage length and a passage with the second passage length disposed adjacent to each other with respect to a rotating direction of the rotary fan.

* * * * *